US005400809A

United States Patent [19]

Adams

[11] Patent Number: 5,400,809

[45] Date of Patent: Mar. 28, 1995

[54] PRESSING COMB, DRYER AND CURLING DEVICE

[76] Inventor: Charles R. Adams, 1932 W. 25th St. #12, Los Angeles, Calif. 90018

[21] Appl. No.: 196,591

[22] Filed: Feb. 15, 1994

Related U.S. Application Data

[63] Continuation-in-part of Ser. No. 48,011, Apr. 19, 1993, abandoned.

[51] Int. Cl.[6] ..... A45D 24/10; A45D 1/04

[52] U.S. Cl. ..... 132/118; 132/232; 34/101; 219/225

[58] Field of Search ..... 132/118, 122, 227, 228, 132/229, 232, 233, 269, 271; 34/96, 97, 101; 219/222, 225, 227

[56] References Cited

U.S. PATENT DOCUMENTS

| | | | |
|---|---|---|---|
| 1,073,336 | 9/1913 | English | 132/232 |
| 1,376,416 | 5/1921 | Forshee | 132/118 |
| 1,388,759 | 8/1921 | Rapizzi | 132/232 |
| 1,536,669 | 5/1925 | Grant | 132/118 |
| 1,580,370 | 4/1926 | Dondanville et al. | 132/118 |
| 1,666,217 | 4/1928 | Nancolas | 132/118 |
| 1,673,071 | 6/1928 | Helsler | 132/118 |
| 1,839,998 | 1/1932 | Selling | 132/232 |
| 1,858,851 | 5/1932 | Buchanan | 132/118 |
| 1,870,496 | 8/1932 | Drannon et al. | 132/227 |
| 2,192,890 | 3/1940 | Boda | 132/232 |
| 2,409,791 | 10/1946 | Pope | 132/232 |
| 2,419,777 | 4/1947 | Howe | 132/118 |
| 3,065,759 | 11/1962 | Lewis | 132/118 |
| 3,173,428 | 3/1965 | Postel | 132/118 |
| 3,220,421 | 11/1965 | Van Droggenbrock et al. | 132/232 |
| 3,696,818 | 10/1972 | Weber | 132/118 |
| 3,981,314 | 9/1976 | Barradas | 132/118 |

FOREIGN PATENT DOCUMENTS

| | | | |
|---|---|---|---|
| 0103163 | 8/1979 | Japan | 132/228 |

*Primary Examiner*—Paul J. Hirsch
*Assistant Examiner*—Frank A. LaViola
*Attorney, Agent, or Firm*—Erik M. Arnhem

[57] ABSTRACT

A hair curling appliance that includes a C-shaped metal barrel and a mating comb member movable to a closed position nested partly within the space circumscribed by the barrel so that the outer curved surfaces of the barrel and comb member collectively form a cylindrical mandrel adapted for winding the person's hair into a multiconvolution curl. An electrical heating element is located within the comb member for heating the comb member and the barrel interior surfaces. Pressurized heated air is supplied to the barrel interior surface to exchange heat with the barrel wall, so as to heat the barrel uniformly hot spots or cold spots.

11 Claims, 3 Drawing Sheets

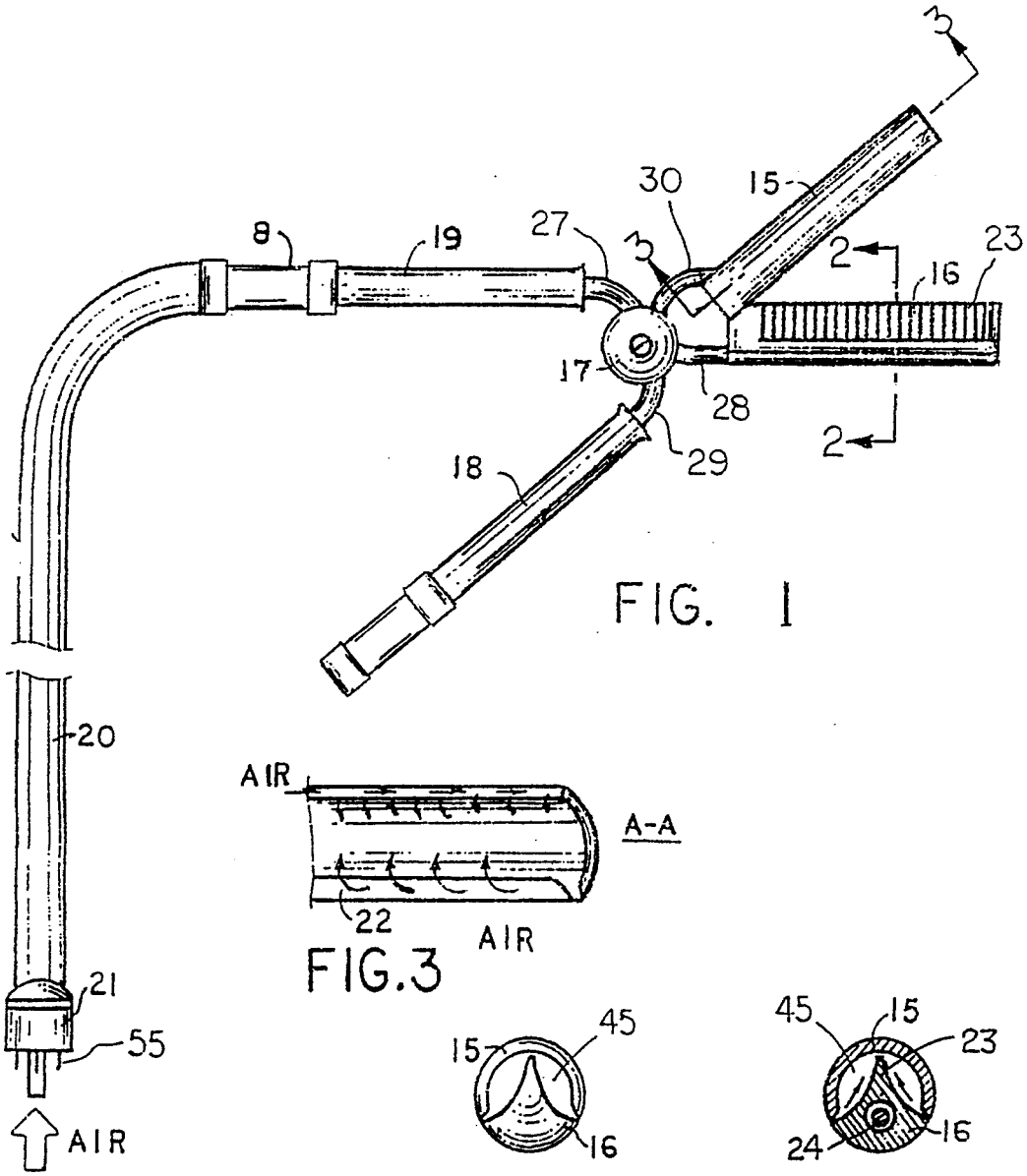
FIG. 1
FIG.3
FIG.4
FIG. 2
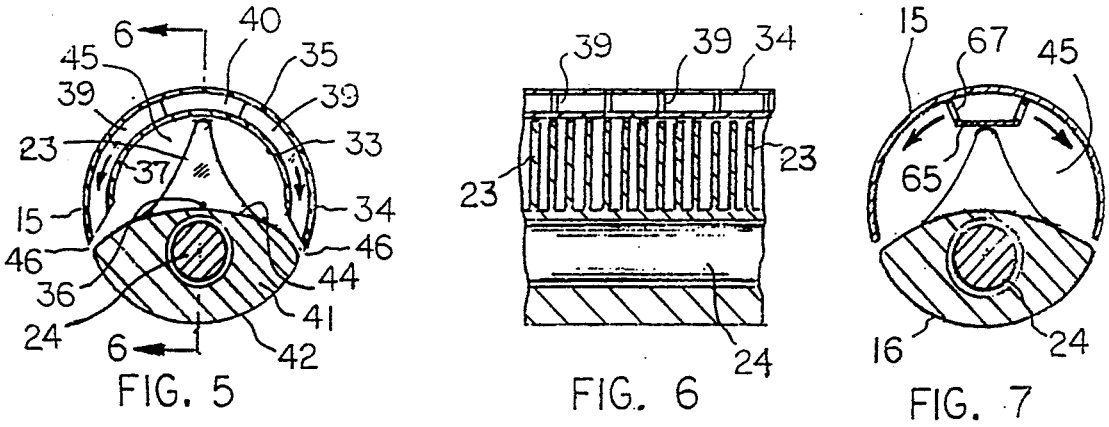
FIG. 5
FIG. 6
FIG. 7

PRESSING COMB, DRYER AND CURLING DEVICE

RELATION TO OTHER PATENT APPLICATION

This application is a continuation-in-part of my patent application, Ser. No. 048,011, filed on Apr. 19, 1993, now abandoned.

BACKGROUND OF THE INVENTION

1. Field of the Invention

This invention relates generally to hair dressing and/or styling devices, and more particularly to an improved hair styling appliance that can be used for combing, pressing, drying and curling the hair substantially in one operation with the controlled application of heat.

2. Prior Developments

The prior art includes U.S. Pat. Nos. 3,102,941; 3,220,421; 3,731,694; 3,892,943; 3,935,423; 4,032,747; 4,163,143; 4,267,430; 4,267,431 and 4,479,047.

U.S. Pat. No. 4,032,747, issued to R. Kung on Jun. 28, 1977, discloses an electrically heated hair styling appliance having two interchangeable attachments that can be selectively positioned flatwise on the side surface of a tubular barrel; the barrel has an electrical heater and a liquid reservoir therein, whereby the liquid can be vaporized for discharge of vapor through a side surface of the barrel. One of the attachments is an elongated blade member seatable against a side surface of the barrel and having slots therein to accommodate the discharge of vapor from the barrel. The other attachment comprises an elongated hair combing clip member installable on the barrel in the space otherwise occupied by the blade member.

U.S. Pat. No. 4,163,143, issued to J. Federico et al. on Jul. 31, 1979, shows a hair curling device that includes an elongated cylindrical barrel having three rows of hair-combing teeth blade is swingably attached to one end of the barrel so that it can swing toward or away from the barrel teeth. With the blade spaced away from the teetch, the person's hair can be placed transversely across the barrel. When the blade is moved to engage the teeth the hair is trapped between the barrel and the blade, whereby the device can be rotated to curl the hair around the outer curved surfaces of the barrel-blade assembly. The teeth act as a spacer to facilitate easier removal of the curled hair from the curling device.

U.S. Pat. No. 4,267,431, granted to R. L. Rick et al. on May 12, 1981, discloses a hair curling device wherein an elongated circular corss-sectioned barrel has an arcuately cross-sectioned hair clamping blade swingably attached to the barrel element for limited movement toward or away from the barrel element surface. An electric motor within the handle of the curling device rotates the barrel element to achieve a hair-curling action. A cam-cam follower mechanism is arranged between the handle and the hair clamping blade so that during the hair-curling operation the blade oscillates a limited distance toward or away from the barrel element surface so as to relieve any excess tension that might conceivably be generated in the hair due to the rotary motion of the barrel element.

U.S. Pat. No. 4,479,047, issued to F. Khaja et al on Oct. 23, 1984, discloses a hair curling device that includes two elongated heated barrel elements having curved outer surfaces and facing flat hair clamping blade is arranged between the two facing surfaces of the barrel elements. The barrel elements can be rotated around the barrel element longitudinal axis so that in one rotated position of said elements the person's hair is clamped between an edge of the flat blade and a rounded edge surface of a barrel element. In a different rotated condition of the barrel elements the flat blade is spaced from the barrel elements, whereby the barrel element assembly can be withdrawn longitudinally from the curled hair. The hair is curled around the curved outer surfaces of the barrel elements.

While many hair curling and styling devices have been proposed, as evidenced by the above-noted patents, there has remained the need for an improved hair styling appliance for combing, drying, pressing and curling hair with the controlled application of heat. The present invention relates to a hair curling appliance that permits a person to achieve the desired combing, drying, pressing and curling in one single action eliminating the standard use of tools and actions which is time consuming and may cause damage to the hair in order to try to achieve a desired result.

SUMMARY OF THE INVENTION

In a preferred embodiment of the invention, the hair-styling appliance includes an elongated barrel and associated comb member, said barrel having a hollow C-shaped cross section, and said comb member including a curvilinear body having a row of teeth projecting into the space circumscribed by the C-shaped barrel. The combination pressing Comb and dryer curling device can be manipulated to achieve a hair curling action by clamping the strands of hair between the comb member 16 and the C-shaped barrel 15 at the base of the strands near the scalp and swinging outwardly, thereby accomplishing the combing, drying and pressing of the hair. Then, by reclamping the strands at the base near the scalp and rotating the device, the strands of hair are drawn in between the comb member 16 and the C-shaped barrel 15 and around the outside surface of the comb member 16 and the C-shaped barrel 15. At the completion of the curl, the full length of the hair strands are wrapped around the outside surface of members 15 and 16, at which time the members 15 and 16 can be pulled from the center.

The comb member is equipped with an internal electric heating element, whereby the total surface of the teeth on the comb member is heated to an elevated temperature. Additionally, an air heating means is provided for supplying heated air to the barrel, whereby the confined space within the C-shaped barrel is heated, such that the barrel surfaces are effectively and uniformly heated. Pressurized heated air is supplied to the barrel interior space, so that when the applieance is used for hair combing and pressing purposes the heated air is in direct contact with the hair, so that the appliance serves simultaneously as a hair dryer.

An aim of the invention is to provide an electrically-heated hair curling appliance wherein the outer surfaces of a barrel and associated comb member are heated to an essentially constant elevated temperature, without localized hot spots or cold spots on either surface. It is believed that by maintaining the hair curling surfaces at a uniform elevated temperature it will be possible to achieve a more consistent and effective hair-curling action.

THE DRAWINGS

FIG. 1 is an exterior view of a hair-curling appliance embodying features of the invention.

FIG. 2 is a sectional view taken on line 2—2 in FIG. 1, but with the comb member in a closed position nested partly within the hollow C-shaped barrel.

FIG. 3 is a fragmentary view taken essentially on line 3—3 in FIG. 1.

FIG. 4 is an end view of the comb member and barrel shown in FIG. 2.

FIG. 5 is a sectional a view taken in .the same direction as FIG. 2, but on a larger scale so as to illustrate details not visible in FIG. 2.

FIG. 6 is a fragmentary sectional view tken on line 6—6 in FIG. 5.

FIG. 7 is a view taken in the same direction as FIG. 5, but illustrating an alternate air passage construction that can be employed in practice of the invention.

DESCRIPTION OF A PREFERRED EMBODIMENT OF THE INVENTION

Figure 9:
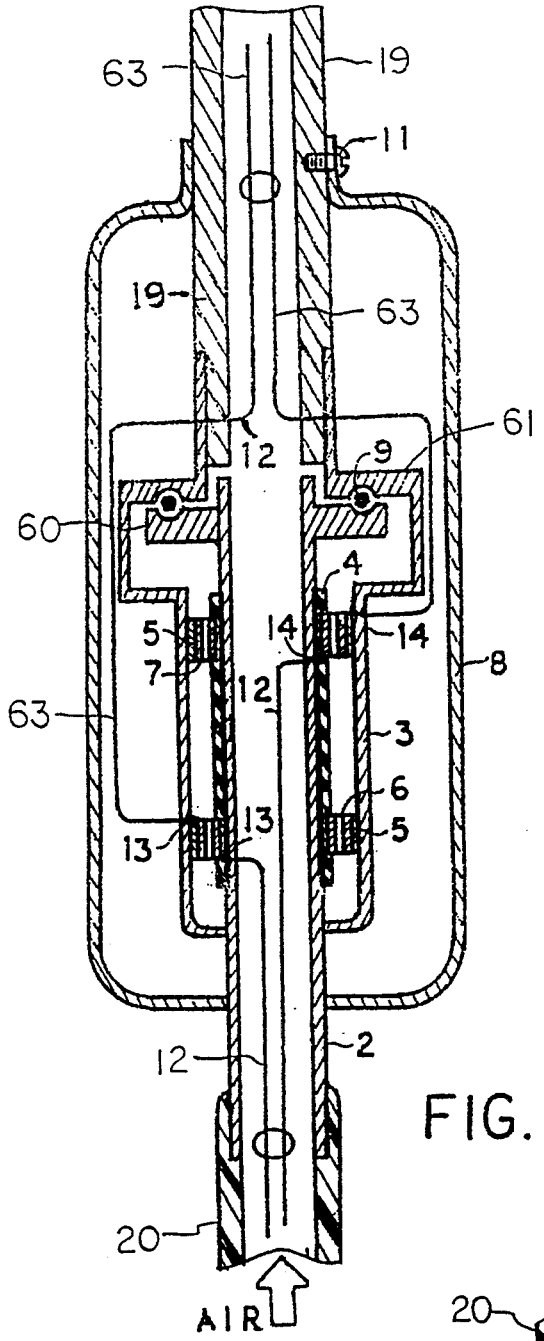
FIG. 9 is an enlarged fragmentary cross sectional view of a swivel joint used between an air supply hose and handle element in the FIG. 1 hair curling device.

FIG. 1 illustrates a scissors-like hair curling element that comprises a hollow barrel 15 and a comb member 16 attached to handles 18 and 19 so that when the handles are brought together, the comb member moves into the barrel to lightly clamp the hair strands near the scalp (not shown). The handles can be rotated around the barrel axis to wind the hair around the outer surfaces of the barrel and comb member, for achievement of a hair curling operation.

Comb member 16 has an electrical heating element therein for heating the comb member 16. Additionally, heated pressurized air is introduced into the space circumstribed by barrel 15 to heat the barrel outer surface.

Barrel 15 has an internal air passage system that receives a pressurized stream of heated air from a flexible hose 20; a small high pressure fan or miniature compressor (not shown) supplies pressurized heated air to the hose.

The heated pressurized air heats the barrel surface and also acts as a hair drying medium when the applieance is used for combing or straightening the hair.

Referring more particularly to the drawings, FIG. 1 shows a hair curling appliance that includes two handles 18 and 19 connected, respectively to an elongated barrel 15 and elongated comb member 16. Barrel 15 preferably has a C-shaped cross-section, as viewed in FIGS. 2 and 5, such that when the associated comb member 16 is moved toward the barrel the teeth 23 of the comb member extend within the confined space formed by the inner facing surfaces of the barrel and comb member.

Figure 8:
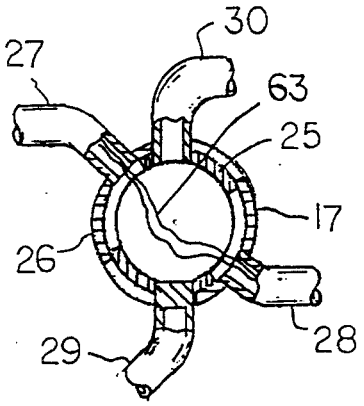
FIG. 8 is a fragmentary sectional view taken through a pivot structure used in the hair curling appliance of FIG. 1.

Numeral 17 illustrates a pivot joint between the two handles 18 and 19, whereby the handles can be manually actuated to open and close the barrel and comb member. FIG. 1 shows the barrel and comb member in the open position wherein the teeth of the comb member are exposed for hair-combing purposes. FIGS. 2 and 5 show the barrel and comb member in the closed position wherein the hair strands can be extended transversely through the tooth spaces so as to be lightly clamped between the opposed surfaces of the barrel and comb member. FIG. 8 illustrates one way that pivot joint 17 can be formed.

As shown in FIG. 8, the pivot joint comprises a circular tube 25 rotatably fitting within a circular sleeve 26. Two small diameter tubes 27 and 28 are connected to sleeve 26, whereas two other tubes 29 and 30 are connected to tube 25. Slots are formed in tube 25 and sleeve 26 to permit limited rotational movement of tube 25 within sleeve 26. As shown in FIG. 1, tube 29 forms part of handle 18, whereas tube 27 forms part of handle 19. By squeezing the two handles together it is possible to bring comb member 16 to a closed position nested partly within barrel 15, as shown in FIG. 5.

The FIG. 8 pivot construction is designed to permit pressurized heated air to flow from tube 27 to tube 30, via the central space formed within tube 25. The joint construction is also designed to accommodate electrical wiring 63 that extends between tubes 27 and 28. Wiring 63 supplies electrical energy to an electrical heating element 24 (FIGS. 2 and 5) located within comb member 16.

The construction of barrel 15 is best visualized from FIGS. 7, 2, 5 and 6. As seen in FIGS. 2 and 5, the barrel has a C-shaped cross section that includes a curved inner surface 33 and a curved outer surface 35, said surfaces being centered on a central axis 36 extending longitudinally along the barrel within the space circumscribed by the C-shaped cross section. Barrel 15 has an outer arcuate wall 34 and an inner arcuate wall 37 spaced radially inwardly from the barrel outer wall to form an air passage system. Transverse partitions 39 extend between the two arcuate walls at spaced points therealong for directing pressurized air in two circumferential directions, as represented by the arrows in FIG. 5.

Pressurized air flows from tube 30 (FIG. 1) into a space 40 formed between the opposed end edges of partitions 39; the air in tube 30 can be heated. The air flows along space 40 generally parallel to the barrel longitudinal axis, with portions of the air branching off into the branch passages formed by partitions 39, such that the air stream comprises a multiplicity of circumferentially moving streams, represented by the arrows in FIG. 5. The pressurized heated air scrubs essentially the entire inner surface of the barrel outer wall 34 so as to heat wall 34 relatively evenly, with minimal localized hot spots or cold spots. Barrel 15 has the same cross-sectional configuration at all points along its length; the end of the barrel air passage system remote from tube 30 is closed as shown in FIG. 4.

Comb member 16 comprises an elongated body 41 having approximately the same length as barrel 15; the body has an elliptical cross section. As shown in FIG. 5, the outer surface 42 of body 41 is curved so as to have the same radius of curvature as the curved outer surface 35 on barrel 15. When the comb member is in its closed position the arcuate surfaces 35 and 42 form a cylindrical mandrel surface adapted to receive the person's hair, whereby rotary manipulation of handles 18 and 19 enables the hair to be wound around surfaces 35 and 42 to achieve a hair curling action; surfaces 35 and 42 collectively form a cylindrical mandrel for achieving a perfect curl. Comb 41 has a single row of teeth 23 projecting from its inner curved surface 44, so that the major plane of each tooth is transverse to the longitudinal central axis 36. As viewed in FIG. 5, each tooth 23 comprises a flat blade element having a triangular profile shape (configuration). With the comb member in a slightly open condition (FIG. 1), the comb member can be drawn through the person's hair to remove snarls and snags.

By bringing the comb member 16 and barrel 16 to a slightly opened condition it is possible to have the barrel sufficiently close to the com so that the heated air within the barrel will be in direct contact with the strands of hair passing through the tooth spaces. As the comb is drawn through the hair with a combing motion the heated air will directly contact the hair to exert a drying and straightening action. The appliance can thus be used as a combination hair dryer, comb and hair straightener.

In an alternate operational mode, the device can be used as a hair curling operation only, with the heated air cut off and the heating element in the comb member 16 switched on. The same operation as described in the "Summary of the Invention" can be applied to achieve a curl by clamping the strands of hair at the base of the strands near the scalp and rotating the device until the total length of the strands is wrapped around the outside surface of the device and then withdrawing the device from the center of the curl.

An elongated rod-like electric heating element 24 extends within a circular bore in comb body 41 so as to heat the comb body and the associated teeth 23. Teeth 23 are preferably formed integrally with body 41 out of a single piece of thermally conductive material, e.g. brass, whereby the teeth are sufficiently heated to radiate heat into the confined space 45 defined by the C-shaped barrel 15. The electric heat augments the barrel heating action of the heated pressurized air so as to add heat to areas of the barrel that might tend to be underheated. The aim is to achieve a fairly uniform heated barrel surface 35, whereby the hair curling action is consistent and repeatable.

The pressurized air flows into confined space 45 via tube 30 into the circumferential passages defined by partitions 39. The air is heated and controlled by a thermostat, thereby permitting the desired temperature of heat necessary for the application. The air escapes directly onto the hair along the longitudinal interior surface of barrel edge 46. The heating element 24 is controlled by a thermostate thereby permitting the desired amount of heat to be applied to a specific texture of hair, preventing over heating that causes damage to the hair. The heating element 24 is primarily used for pressing and curling the hair, and the heated air is primarily used for drying the hair. Both heating means applied together makes the device an effective tool, facilitating combing of the kinks and extreme curles of the hair.

As previously noted, the air supplied to hose 20 can be heated. The air heating function can be achieved by incorporating a small electric heating element into a high pressure fan connected to hose 20. Alternately, an electrical air heater can be incorporated into housing 50. The heated pressurized air is passed through a passage in housing 50 into one end of hose 20.

Figure 10:
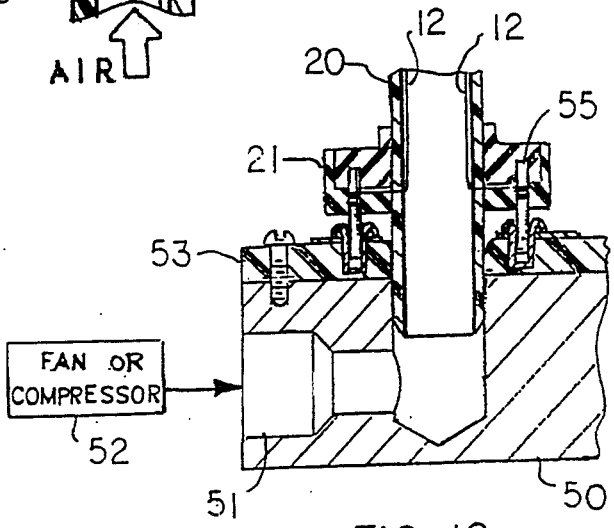
FIG. 10 is a fragmentary sectional view through a device for supplying electrical power and pressurized air to a flexible hose used in the FIG. 1 hair curling appliance.

Hose 20 can be used as a conduit for electrical wiring that supplies electrical current to heating element 24 in comb 16. As shown in FIG. 10, an electrical circuit board 53 is mounted on housing 50 to form electrical connections between a power supply and pin type terminals 55 carried by an electrical plug 21 on the associated end of hose 20. Control switches, not shown, can be mounted on circuit board 53. Terminals 55 are connected to electrical wiring 12 for delivery of electrical energy along the associated hose 20. Electrical wiring 12 may be embedded within the wall of hose 20 or exgend loosely within the hose.

Hose 20 delivers pressurized air to a steel tube 2 located within a tubular housing 8 (FIG. 9). FIG. 1 shows housing 8 as an extension of handle 19. FIG. 9 shows housing 8 as a protective housing attached to the handle via a set screw 11. The lower end of protective housing 8 has a clearance fit on steel tube 2, so that the housing can swivel (rotate) with handle 19 without producing an undesired twist in hose 20.

Tube 2 has a radial plate 60 at its upper end registering with a radial wall 61 carried by handle 19; an O-ring seal 9 is arranged between the radial walls to prevent leakage of air at the joint between tube 2 and handle 19. Tube 2 is rotatably supported within a handle extension sleeve 3 by means of two needle bearings 6 and 7; sleeve 3 constitutes an extension of handle 19. Bearings 6 and 7 can be used to transfer electrical current between electrical wires 12 (in hose 20) and electrical wires 63 (extending within handle 19).

As schematically illustrated in FIG. 9, each electrical wire 12 has one end thereof attached to the inner race of a neede bearing 6 or 7. The corresponding end of the associated electrical conductor 63 is attached to the outer race of the needle bearing. The anti-friction elements in the bearings serve as current conductors. Suitable insulation must be provided between the bearing races and the tubular elements 2 and 3 to prevent a short circuit.

Electrical wiring 63 extends through handle 19 (FIG. 1) and tube 27. As shown in FIG. 8, wiring 63 extends from tube 27 through the pivot joint 17 into tube 28. The wiring terminates at heating element 24 (FIGS. 2, 5 and 6).

FIG. 5 shows a particular air passage system for supplying heated pressurized air to the confined space within barrel 15. FIG. 7 shows an alternate passage system comprising a channel member 65 extending longitudinally within the barrel. Ports 67 are formed in the channel member flanges at spaced points along the channel member length, whereby the pressurized air is distributed relatively evenly along the barrel wall 34. FIG. 5 represents the preferred air distribution system.

By way of summarization, the invention contemplates a hair curling appliance that includes an elongated C-shaped barrel 15, and a mating comb member 16 having a single row of teeth 23 adapted to extend within the confined space 45 defined by the C-shaped barrel.

Comb member 16 is electrically heated by an elongated rod-like heating element 24 extending within the elliptically shaped comb body 41. Teeth 23 are integrally formed with body 41 so that the teeth are heated by the heating action of heating element 24. A pressurized stream of heated air is supplied to confined space 45 so as to heat barrel 15, such that the outer curved surfaces of the barrel and comb member 16 are heated to a temperature sufficient to promote a desired hair curling action when the hair is wound around the heated surfaces 35 and 42. Surfaces 35 and 42 collectively form a cylindrical mandrel adapted for winding the hair therearound.

Pressurized heated air is conducted through a flexible hose 20 and handle 19 for passage into the barrel 15. The swirling air scrubs the heated interior surfaces of barrel 15 to promote a uniform heating action on the various metal surfaces. Barrel 15 is preferably made of aluminum or steel and the comb member 16 preferably made of brass .for heat conduction purposes.

Handle 19 preferably has a swivel connection with hose 20, such that the handle can be manually turned around its longitudinal axis without imparting any twist or torsional distortion into the hose material.

Figure 11:
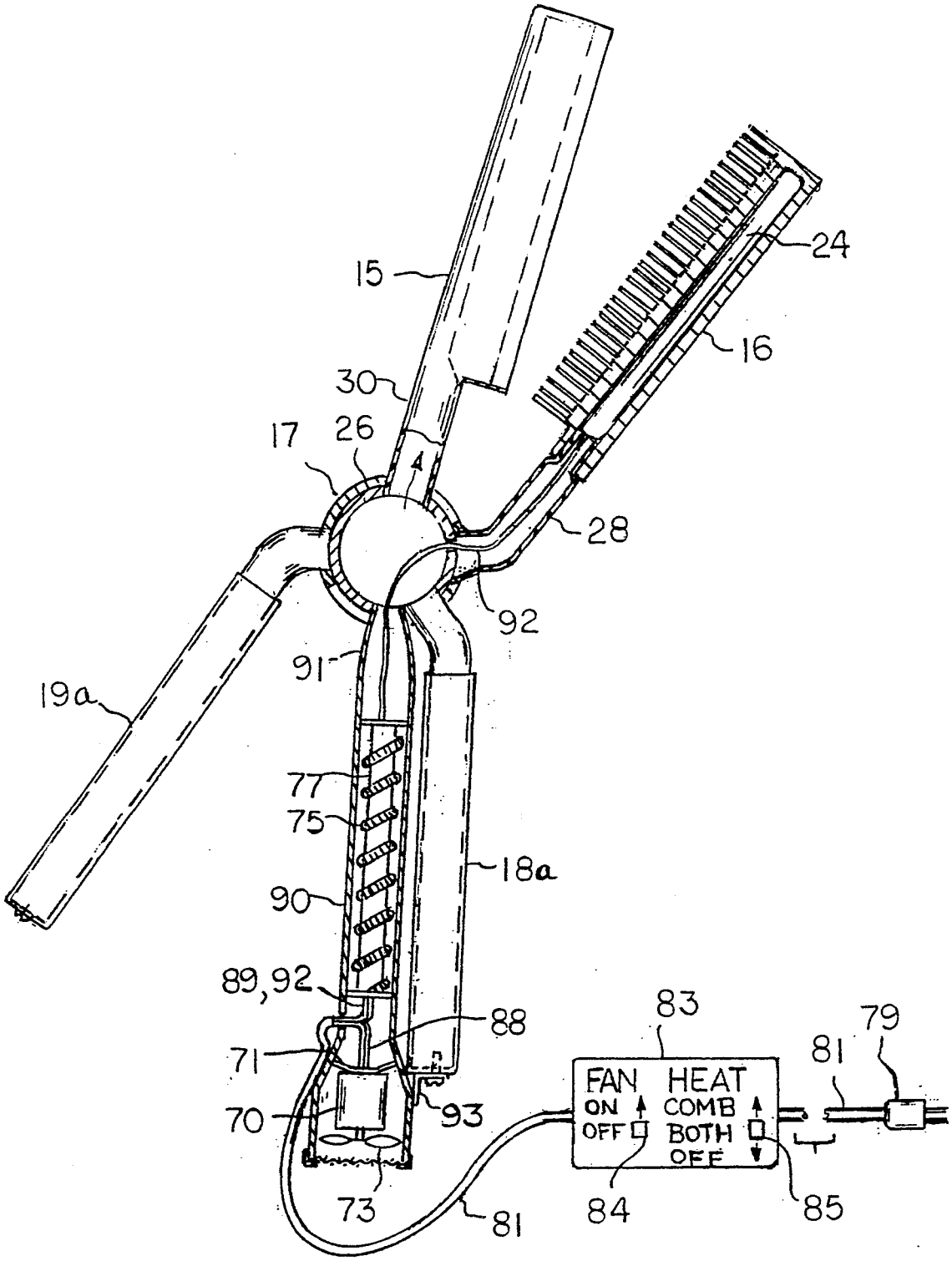
FIG. 11 is a view, partly in section, of another hair-curling appliance constructed according to the invention.

FIG. 11 shows another form of the invention, wherein a fan and electric heater are incorporated into the handle structure of the hair curling device. The fan comprises a motor 70 mounted on a bracket 71 within an enlarged space at the end of a tubular housing 90 connected to an air duct 91. Handle member 18*a* is attached to duct 91 so as to extend generally parallel to tubular housing 90. A bracket 93 extends from housing 90 for receiving a screw that threads into the end of handle 18a, thereby rapidly attaching the handle to the housing.

Referring to the structure within housing 90, a propeller 73 is mounted on the motor 70 shaft for moving air upwardly through housing 90 when motor 70 is energized. The upper end portion of housing 90 houses an electric heating element 75. As shown in FIG. 11, the heating element comprises an elongated wire coil wound on a cylindrical mandrel (of form) 77 coaxial with the tubular housing. Mounting brackets are provided at opposite ends of the mandrel to center the mandrel within the housing, and to also close the mandrel ends. Air flows through the annular space surrounding mandrel 77; when the electrical heating element is energized the following air is heated as it passes across the heating element.

The flowing air moves through a hollow pivot joint 17 into a C cross-sectioned barrel 15 carried by tube 30. The pivot joint and barrel are constructed generally as shown in FIGS. 2 and 7.

The hair curling device further comprises a comb 16 connected to a tube 28 that extends from the pivot joint 17, in the same fashion as previously described. A comb heating element 24 is located within a cylindrical socket in the comb, whereby the comb can be heated to facilitate the hair curling and hair drying operations.

In the pivot structure depicted in FIG. 11 comprises the hollow tube 25 that is connected to tubes 91 and 30. Sleeve 26 is attached to handle element 19*a* and tube 28, as well as handle 18*a*. Handle elements 18*a* and 19*a* can be rods or tubes. Preferably each handle element has a plastic rotatable sleeve extending therealong to provide a comfortable surface for the person's hand. The handle elements can be designed so as to be close enough together for one-handed operation of the handle elements. Comb 16 is brought into the barrel 15 space by squeezing the handle elements 18*a* and 19*a* together.

Electrical power can be supplied to heating element 24, motor 70, and heating element 75 by the conventional household power supply. An electrical plug 79 at one end of an insulated power cord 81 plugs into an electrical wall outlet (not shown); a manual switch casing 83 is incorporated into cord 81 for controlling current flow through motor 70 and the two heating elements 75 and 24. As schematically shown in the drawing, one slider switch button 84 controls current flow to the motor, and a second slider button 85 controls current flow to heating elements 75 and 24. With the particular switch arrangement depicted in FIG. 11, switch-operator button 85 has three positions, namely off position, an intermediate position wherein both heating elements 75 and 24 are energized, and an upper position wherein only the comb heating element 24 is energized. Various switch arrangements could be used.

The electrical wiring harness can include multiple insulated connector wires extending along the outer surface of tubular housing 90 and through a hole in the housing side wall into the space between motor 70 and heating element 75. Two conductors 88 supply current to the motor. Other conductors 89 and 92 supply current to heating elements 75 and 24. Conductors 92 extend through mandrel 77 and pivot joint 17 in order to reach heating elements 24.

The hair curling appliance of FIG. 11 operates in the same fashion as the appliance shown in FIG. 1. The difference between the two appliances is primarily the location for the heating element 75 and fan.

In the FIG. 11 appliance the fan motor and heating element 75 are located within the appliance handle structure, whereas in the FIG. 1 appliance the corresponding fan and heating element are remotely located.

What is claimed is:

1. A hair curling appliance comprising an elongated barrel having a C-chaped cross section; and an elongated comb member movable between an open position spaced from the barrel, and a closed position nested partly within the barrel; said barrel having an inner surface and an arcuate outer surface having a radius of curvature generated from a central axis extending longitudinally along the barrel within its C-shaped cross section; said elongated comb member comprising a main body having an arcuate outer surface having the same radius of curvature as the barrel outer surface; said comb member being connected to the barrel so that when the comb member is in its closed position the arcuate outer surfaces of the barrel and comb member collectively form a cylindrical mandrel adapted for winding a person's hair therearound; the main body of said comb member having an inner surface facing the inner surface of said C-shaped barrel so that when the comb member in its closed position a confined space is formed within the C-shaped barrel; a single row of regularly spaced teeth projecting from the inner surface of the comb member main body, whereby said teeth retain the strands of hair in a position extending transverse to the aforementioned central axis; an electric heating element extending longitudinally within the comb member main body for heating the inner and outer surfaces of said main body; and means for supplying a pressurized stream of heating air to the confined space within the C-shaped barrel.

2. The hair curling appliance of claim 1, wherein each tooth of the comb member comprises an essentially flat blade having a triangular profile.

3. The hair curling appliance of claim 2, wherein said teeth are integral with said comb member main body; said comb member being formed of a thermally conductive material whereby the teeth are heated by the electric heating element.

4. The hair curling appliance of claim 1, wherein said air supply means comprises an air supply passage extending longitudinally along the inner surface of the barrel, and a number of branch passage extending laterally from said air supply passage at spaced points therealong, whereby the heated air scrubs essentially the entire inner surface of the barrel.

5. The hair curling appliance of claim 1, wherein the comb member main body has an essentially elliptical cross section; the inner surface of said main body having an arcuate profile each tooth of the comb member comprising a flat triangular-shaped blade projecting from the inner surface of the comb member main body.

6. The hair curling appliance of claim 5, wherein said central axis is located on the arcuate inner surface of the comb member main body.

7. The hair curling appliance of claim 1, and further comprising a first handle connected to said comb member; a second handle connected to said barrel; and a pivot connection between said handle members, whereby the comb member can be moved toward or away from the barrel by manual manipulation of the handles.

8. The hair curling appliance of claim 7, wherein said air supply means comprises a fan and an electric heating means located within one of said handles.

9. The hair curling appliance of claim 8, wherein said electric heating means comprises a second electric heating element located downstream from said fan.

10. The hair curling appliance of claim 7, wherein said pivot connection comprises a hollow tube connected to one of said handles, and a sleeve connected to the other handle; said sleeve having a rotary sliding telescopic fit on said tube, whereby pressurized air can flow through the pivot connection into said barrel.

11. The hair curling appliance of claim 1, and further comprising a first handle connected to said comb member; a second handle connected to said barrel; a pivot connection between said handle members, whereby the comb member can be moved toward or away from the barrel; a flexible hose connected to said first handle for delivering pressurized heated air to the confined space within the barrel; a swivel connection between said hose and said first handle whereby said first handle can be rotated without imparting a torsional stress to the hose; and an electrical current conductor means extending along the hose and across the swivel connection for supplying current to said heating element.

* * * * *